US006579843B2

(12) United States Patent
Cropper et al.

(10) Patent No.: US 6,579,843 B2
(45) Date of Patent: Jun. 17, 2003

(54) WATER-SOLUBLE PACKAGE AND PREPARATION THEREOF

(75) Inventors: James Dawson Cropper, Merseyside (GB); Richard Harbour, Cheshire (GB)

(73) Assignee: Unilever Home & Personal Care USA, division of Conopco Inc., Greenwich, CT (US)

( * ) Notice: Subject to any disclaimer, the term of this patent is extended or adjusted under 35 U.S.C. 154(b) by 69 days.

(21) Appl. No.: 09/963,231

(22) Filed: Sep. 26, 2001

(65) Prior Publication Data

US 2002/0165109 A1 Nov. 7, 2002

(30) Foreign Application Priority Data

Sep. 27, 2000 (GB) ..... 0023713

(51) Int. Cl.[7] ..... C11D 17/00

(52) U.S. Cl. ..... 510/439; 510/441; 510/443; 510/444

(58) Field of Search ..... 510/507, 444, 510/443, 325, 308, 324, 441, 306, 439

(56) References Cited

U.S. PATENT DOCUMENTS

| | | | | |
|---|---|---|---|---|
| 4,115,292 A | * | 9/1978 | Richardson et al. | 510/392 |
| 4,269,729 A | * | 5/1981 | Maruyama et al. | 428/402.22 |
| 4,416,791 A | | 11/1983 | Haq | 252/90 |
| 6,492,312 B1 | * | 12/2002 | Pfeiffer et al. | 510/221 |

FOREIGN PATENT DOCUMENTS

| | | |
|---|---|---|
| EP | 0 217 186 | 4/1987 |
| GB | 2 305 931 | 4/1997 |
| JP | 1029438 | 1/1989 |
| WO | 89/04282 | 5/1989 |

OTHER PUBLICATIONS

PCT International Search Report in a PCT application PCT/EP 01/10853, Oct. 2001.

* cited by examiner

*Primary Examiner*—Greg Webb
(74) *Attorney, Agent, or Firm*—Kevin J. Stein

(57) ABSTRACT

A water-soluble package comprises a composition such as a liquid detergent composition enclosed within a water-soluble film. The film, or at least a substantial portion thereof, is dusted with a powder such as talc, starch, calcium stearate or zinc stearate by passing the package through a cloud or fluidized bed of the particles.

17 Claims, 1 Drawing Sheet

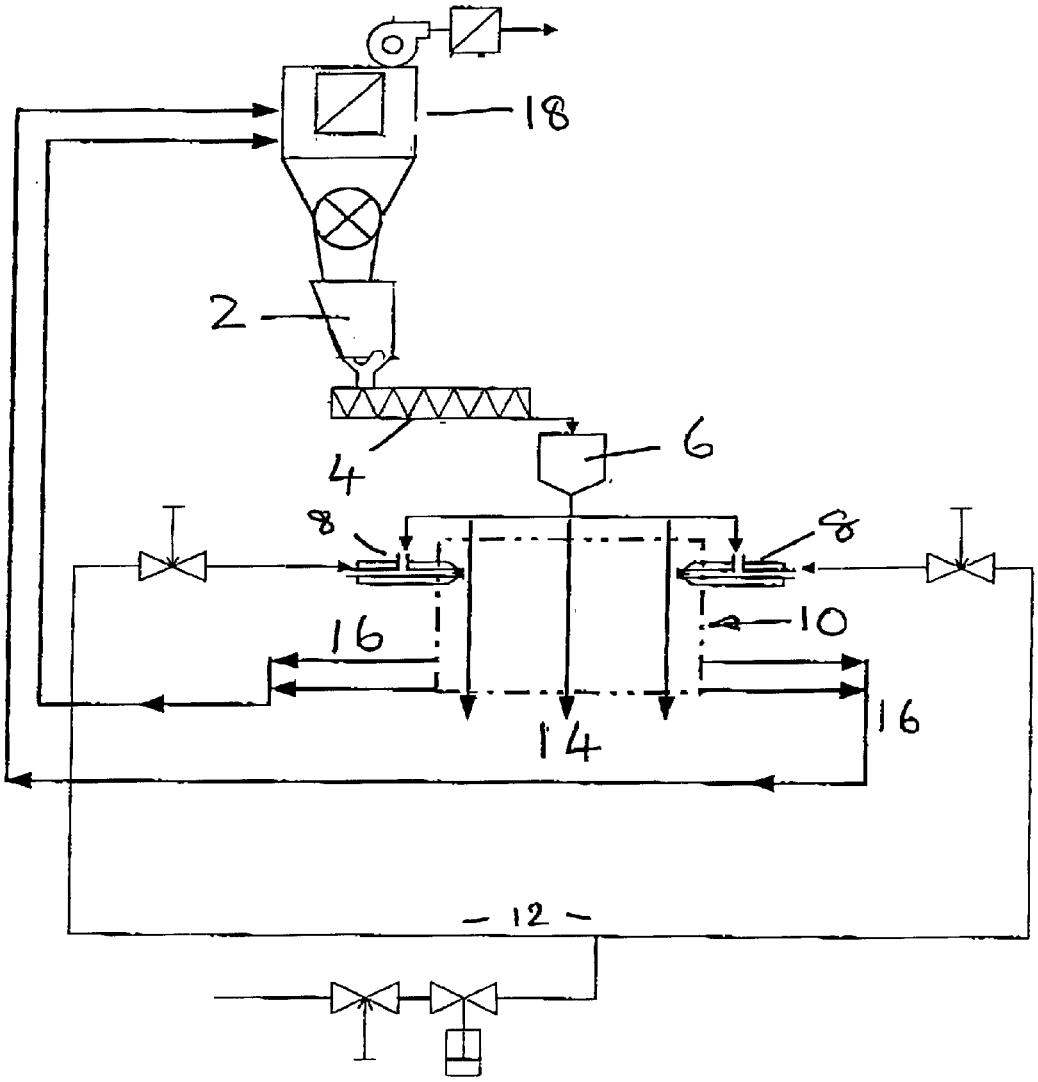
18
2
4
6
8
8
10
16
16
14
12

WATER-SOLUBLE PACKAGE AND PREPARATION THEREOF

INTRODUCTION

The invention relates to a water-soluble package and to its preparation. In particular the invention relates to liquid detergent enclosed within a water-soluble film.

Water-soluble packages are known and are disclosed, for example in GB-A-2305931 and W089/04282. In the agrochemical industry known water-soluble packages generally comprise either vertical form-fill-seal (VFFS) envelopes or thermoformed envelopes. In one of the VFFS processes, a roll of water-soluble film is sealed along its edges to form a tube, which tube is the heat sealed intermittently along its length to form individual envelopes which are filled with product and heat sealed. The thermoforming process generally involves moulding a first sheet of water-soluble film to form one or more recesses adapted to retain a composition, such as for example a solid agrochemical composition, placing the composition in the at least one recess, placing a second sheet of water-soluble material over the first so as to cover the or each recess, and heat sealing the first and second sheets together at least around the recesses so as to form one or more water-soluble packages.

JP-1029438 discloses a polyvinyl alcohol type film useful as a packaging material which has a coating of fine powder obtained by spraying an aqueous dispersion containing the powder on the surface of the PVA film. Suitable powders includes calcium carbonate, magnesium carbonate, clay, talc, silicic acid and kaolin. The coating is said to provide excellent slip and anti-blocking properties while retaining heat sealability and the film does not release the fine powder.

Generally, water-soluble packages suffer a number of disadvantages. First, as the packages are susceptible to moisture, the composition, which can be contained within the package, is limited. Secondly, the storage and transport of such packages must be carefully controlled as humidity in the atmosphere can weaken the structural integrity of the formed packages.

It is an object of the present invention to overcome at least some of the above disadvantages.

STATEMENTS OF INVENTION

It has been surprisingly discovered that water-soluble packages have a tendency to stick together when a number of them are stored in close proximity over a period of time. A further discovery of the applicants is that when a secondary package containing a plurality of such stuck-together packages is subjected to external impact, then the likelihood of the packages maintaining their integrity, ie not rupturing or breaking, is greater then when compared with the situation where the packages have not stick together.

Accordingly, the invention provides a water-soluble package comprising a composition, such as for example a liquid detergent composition, enclosed within a water-soluble film, wherein at least a potion of a surface of the package includes a dusting of powder. Thus, when a plurality of such water-soluble packages are stored or transported in close proximity they will be less prone to stick together. Further, the invention provides a plurality of the water-soluble packages according to the invention packaged within a secondary pack.

In one embodiment of the invention, the powder has an average particle size of between 0.1 and 20 microns, suitably between 5 and 15 microns. Typically, a powder such as talc could be used, such a powder being well known. Other suitable materials include calcium stearate and zinc stearate. Alternatively a suitable fine grade of starch may be used. Generally the powder will be inert, and ideally easily dispersible in water.

The powder is generally applied at a rate of from 0.5 to 10 mg/100 $cm^2$, preferably not more than 5 mg/100 $cm^2$, more preferably in the range 1.25 to 2.5 mg/100 $cm^2$.

In a preferred embodiment of the invention the film is a polyvinyl alcohol, or modified polyvinyl alcohol, film. Typically, the composition is a fluent composition such as for example a liquid, gel or paste. Preferably, each package will contain up to one liter of composition, ideally between 10 and 50 ml, most preferably between 15 and 30 ml. In an envisaged embodiment, the composition will include detergent suitable for use in the machine washing of laundry or dishes. The composition may include from 1 to 15%, generally up to 10% by weight water, ideally between 3 and 7% by weight water. Generally the packages of the invention will be resiliently deformable, and the powder will ideally coat or dust a substantial portion of the package surface.

Preferably the water-soluble package of the invention comprises a first sheet of water-soluble material moulded to form a body portion of the capsule, and a second sheet of water-soluble material superposed on the first sheet and sealed thereto by a closed seal along a continuous region of the superposed sheets, wherein at least a portion of the formed package includes an external coating or dusting of a powder. Typically, the fluent composition is a detergent liquid or gel suitable for use in the machine washing of fabrics or dishes.

The invention further relates to a process for producing a water-soluble package by thermoforming or vertical form fill seal (VFFS)techniques, the process being characterised in that the formed package is brought into contact with a powder such that that a dusting of fine powder is applied to at least a portion of a surface of the package. Typically, the powder is applied using a fluidised bed, by spraying or using a falling curtain.

DETAILED DESCRIPTION OF DRAWINGS

FIG. 1 illustrates the powder coating apparatus.

DETAILED DESCRIPTION OF THE INVENTION

The invention will be more clearly understood from the following description of an embodiment thereof, given by way of example only.

EXAMPLE

In this Example a thermoforming process is described where a number of packages according to the invention are produced from a single sheet of water-soluble material. In this regard recesses are formed in the sheet using a forming die having a plurality of cavities with dimensions corresponding generally to the dimensions of the packages to be produced. Further, a single heating plate is used for moulding the film for all the cavities, and in the same way a single sealing plate is described.

A first sheet of polyvinyl alcohol film is drawn over a forming die so that the film is placed over the plurality of forming cavities in the die. Each cavity is generally dome shape having a round edge, the edges of the cavities further being radiussed to remove any sharp edges which might damage the film during the forming or sealing steps of the process. Each cavity further includes a raised surrounding flange. In order to maximise package strength, the film is delivered to the forming die in a crease free form and with minimum tension. In the forming step, the film is heated to 100 to 120 degrees C., preferably approximately 110 degrees C., for up to 5 seconds, preferably approximately 700 micro seconds. A heating plate is used to heat the film, which plate is positioned to superpose the forming die. The plate includes a plurality concave depressions which correspond to the recesses on the forming die. During this preheating step, a vacuum is pulled through the pre-heating plate to ensure intimate contact between the film and the pre-heating plate, this intimate contact ensuring that the film is heated evenly and uniformly (the extent of the vacuum is dependant of the thermoforming conditions and the type of film used, however in the present context a vacuum of less than 0.6 bar was found to be suitable) Non-uniform heating results in a formed package having weak spots. In addition to the vacuum, it is possible to blow air against the film to force it into intimate contact with the preheating plate.

The thermoformed film is thus moulded into the cavities forming a plurality of recesses which, once formed, are retained in their thermoformed orientation by the application of a vacuum through the walls of the cavities. This vacuum is maintained at least until the packages are sealed. Once the recesses are formed and held in position by the vacuum, the composition, in this case a liquid detergent, is added to each of the recesses. A second sheet of polyvinyl alcohol film is then superposed on the first sheet covering the filled recesses and heat-sealed thereto using a heating plate. In this case the heat sealing plate, which is flat, preferably operates at a temperature of about 140 to 160 degrees centigrade, and ideally contacts the films for 1 to 2 seconds and with a force of 8 to 30 kg/cm2, preferably 10 to 20 kg/cm2. The raised flanges surrounding each cavity ensures that the films are sealed together along the flange to form a continuous closed seal. The radiussed edge of each cavity is typically at least partly formed a by a resiliently deformable material, such as for example silicone rubber. This results in reduced force being applied at the inner edge of the sealing flange to avoid heat/pressure damage to the film.

Once sealed, the packages formed are separated from the web of sheet film using cutting means. At this stage it is possible to release the vacuum on the die, and eject the formed packages from the forming die. In this way the packages are formed, filled and sealed while nesting in the forming die. In addition they may be cut while in the forming die as well.

Experimental 25 g hemispherical shaped capsules produced as described above were used in the following tests. 40 capsules were introduced into a plastic bag having a moisture vapour transmission rate (MVTR) in the range 1 to 20 $g/m^2/24$ hours.

A weighed amount of powder, either 14 mg, 28 mg or 56 mg, is introduced onto the top of the capsules and mixed by closing and shaking the bag for 1 minute.

After mixing, the 40 capsules were divided into two lots of twenty and each lot placed in a smaller plastic bag having a MTVR in the range 1 to 20 $g/m^2/24$ hours, which bag was left either open or closed and placed into a cardboard outer container designed to accommodate twenty capsules.

The top of the outer box was closed. The boxes were stored at either:

1. 20° C. and 60% relative humidity (RH) or
2. 37° C. and 70% RH

The samples were assessed at 1, 2, 4, 8 and 12 weeks respectively.

The samples were assessed according to the following scoring system:

0—No sticking

1—less than 5 sticking

2—less than 20 but more than 4

3—less than 40 but more than 19

4—all sticking, but no damage when pulled apart

5—all sticking, severe damage when pulled apart

The following powders were tested as anti-blocking agents:

Zinc Stearate

Bulk Density 300 g/l

Sieve Residue 200 mesh—0.5%

Median Particle Size Diameter—14.63$\mu$

Calcium Stearate

Bulk Density 150 g/l

Sieve Reside 200 mesh—0.5%

Median Particle Size Diameter—3.63$\mu$

Starch

Having a comparable particle size to the calcium stearate

Talc(Mistron Flair HT MM commercially available from LUZENAC NV)

Median Particle Size Diameter—11$\mu$ (approximately)

Particle Range 100$\mu$ to 0.4$\mu$

Tapped Density 0.92 $kg/dm^3$

Loose Density 0.50 $kg/dm^3$

Pass Through 200 mesh—99%

TABLE 1

Table 1 reports the results of the assessments.

| Powder | Level/mg | Bag Open/Closed | Storage conditions | 1 week | 2 week | 5 week | 8 week | 12 week |
|---|---|---|---|---|---|---|---|---|
| Control (none) | | open | 20/60 rh | 4 | 4 | 4 | 4 | 4 |
| Control (none) | | closed | 20/60 rh | 4 | 4 | 4 | 4 | 4 |
| Control (none) | | open | 37/70 rh | 4 | 4 | 4 | 4 | 4 |
| Control (none) | | closed | 37/70 rh | 4 | 4 | 4 | 4 | 4 |
| Talc | 14 | open | 20/60 rh | 1 | 1 | 0 | 1 | 1 |
| Talc | 14 | closed | 20/60 rh | 2 | 2 | 1 | 1 | 1 |
| Talc | 14 | open | 37/70 rh | 4 | 3 | 3 | 3 | 3 |
| Talc | 14 | closed | 37/70 rh | 4 | 4 | 3 | 3 | 3 |
| Talc | 28 | open | 20/60 rh | 0 | 1 | 0 | 0 | 0 |
| Talc | 28 | closed | 20/60 rh | 0 | 0 | 0 | 0 | 0 |

TABLE 1-continued

Table 1 reports the results of the assessments.

| Powder | Level/mg | Bag Open/Closed | Storage conditions | 1 week | 2 week | 5 week | 8 week | 12 week |
|---|---|---|---|---|---|---|---|---|
| Talc | 28 | open | 37/70 rh | 1 | 0 | 0 | 1 | 0 |
| Talc | 28 | closed | 37/70 rh | 1 | 1 | 0 | 1 | 1 |
| Talc | 56 | open | 20/60 rh | 0 | 0 | 0 | 0 | 0 |
| Talc | 56 | closed | 20/60 rh | 0 | 0 | 0 | 0 | 0 |
| Talc | 56 | open | 37/70 rh | 0 | 0 | 0 | 0 | 0 |
| Talc | 56 | open | 37/70 rh | 0 | 0 | 0 | 0 | 0 |
| Zinc Stearate | 14 | open | 20/60 rh | 0 | 0 | 0 | 0 | 0 |
| Zinc Stearate | 14 | closed | 20/60 rh | 0 | 0 | 0 | 0 | 0 |
| Zinc Stearate | 14 | open | 37/70 rh | 1 | 1 | 3 | 4 | 4 |
| Zinc Stearate | 14 | closed | 37/70 rh | 2 | 1 | 1 | 2 | 3 |
| Zinc Stearate | 28 | open | 20/60 rh | 0 | 0 | 0 | 0 | 0 |
| Zinc Stearate | 28 | closed | 20/60 rh | 0 | 0 | 0 | 0 | 0 |
| Zinc Stearate | 28 | open | 37/70 rh | 0 | 0 | 0 | 1 | 4 |
| Zinc Stearate | 28 | closed | 37/70 rh | 0 | 0 | 0 | 1 | 4 |
| Calcium Stearate | 14 | open | 20/60 rh | 0 | 0 | 0 | 0 | 0 |
| Calcium Stearate | 14 | closed | 20/60 rh | 0 | 0 | 0 | 0 | 0 |
| Calcium Stearate | 14 | open | 37/70 rh | 1 | 1 | 3 | 3 | 4 |
| Calcium Stearate | 14 | closed | 37/70 rh | 1 | 1 | 3 | 4 | 4 |
| Calcium Stearate | 28 | open | 20/60 rh | leaker | leaker | leaker | leaker | leaker |
| Calcium Stearate | 28 | closed | 20/60 rh | 0 | 0 | 0 | 0 | 0 |
| Calcium Stearate | 28 | open | 37/70 rh | 0 | 0 | 1 | 3 | 4 |
| Calcium Stearate | 28 | closed | 37/70 rh | 0 | 0 | 1 | 0 | 4 |
| Calcium Stearate | 56 | open | 20/60 rh | 0 | 0 | 0 | 0 | 0 |
| Calcium Stearate | 56 | closed | 20/60 rh | 0 | 0 | 0 | 0 | 0 |
| Calcium Stearate | 56 | open | 37/70 rh | 0 | 0 | 0 | 0 | 2 |
| Calcium Stearate | 56 | closed | 37/70 rh | 0 | 0 | 0 | 0 | 2 |
| Starch | 14 | open | 20/60 rh | 0 | 0 | 0 | 0 | 1 |
| Starch | 14 | closed | 20/60 rh | 0 | 1 | 0 | 0 | 1 |
| Starch | 14 | open | 37/70 rh | 1 | 0 | 0 | 1 | 2 |
| Starch | 14 | closed | 37/70 rh | 0 | 0 | 0 | 0 | 2 |
| Starch | 28 | open | 20/60 rh | 0 | 0 | 0 | 0 | 0 |
| Starch | 28 | closed | 20/60 rh | 0 | 0 | 0 | 0 | 0 |
| Starch | 28 | open | 37/70 rh | 0 | 0 | 0 | 0 | 1 |
| Starch | 28 | closed | 37/70 rh | 0 | 0 | 0 | 0 | 0 |

The results show that all powders provide an improvement over the control.

At 37° C./70% RH at a dosage level of 28 mg per 40 capsules, calcium stearate, zinc stearate and starch prevent blocking for up to 5 weeks. Some blocking occurs however with talc at this dosage level Talc is effective under all conditions at a dosage of 56 mg per 40 capsules for at least 12 weeks. Obvious differences between open or closed bags during storage were observed.

At the higher levels of application both stearate powders are visible on the surface of the capsules, this is particularly so at 56 mg dosage for calcium stearate.

The zinc stearate is not nearly so obvious.

At the 56 mg dosage level talc is not obviously visible on the capsule surface.

Starch behaves more like the talc than the stearates.

Considering issues of safety, ease of machine handling and performance, talc is the preferred powder.

An alternative process of powder coating the capsules is schematically illustrated in the accompanying drawing. Powder is held in hopper (2) which is provided with an agitator (not shown) to ensure the powder is deagglomerated and free flowing. The powder is fed from the hopper (2) by a screw conveyor (4) to a sealed tundish (6). Powder is fed from the tundish (6) to spray nozzles (8) where powder is sprayed into a spray chamber (10) by compressed air from line (12). A fluidised bed or cloud of powder is formed in the spray chamber.

Capsules are fed to the top of the spray chamber (10) by a vacuum conveyor (not shown). Capsules are dropped off the end of the conveyor in three streams having a staggered relationship with the dropping sequence alternating from the outer pair of capsules to the inner. The capsules fall vertically under gravity through the spray chamber (10) as shown by the three arrows (14) and are powder coated as they pass through the cloud of particles. The powder coated capsules are collected from the base of the spray chamber and packaged.

Powder from the spray chamber is pneumatically extracted via lines (16) and fed to an extraction unit (18) where it is collected and recycled to the hopper (2).

A series of tests were conducted using the capsules and talc of the previous tests.

The powder spray was adjusted to provide different coating levels:

13.80 mg/100 $cm^2$ 8.05 mg/100 $cm^2$ 4.60 mg/100 $cm^2$ 4.21 mg/100 $cm^2$ 1.53 mg/100 $cm^2$

Storage stability tests were conducted as described above. All levels of talc proved to be effective after 12 weeks at both 20° C./60% RH and 37° C./70% RH Typically, the packaging step comprises packing a plurality of the dusted capsules in an intermediate pack having a suitable moisture barrier and sealing or closing the intermediate pack before placing the bag within a secondary pack such as a carton. Generally the intermediate pack will be a plastic bag having a moisture vapour transmission rate (MVTR) of between 1 and 20 g/m2/24 hours. Suitable packaging substrates having MVTR values in this range will be known to those skilled in the art. Alternatively, a plurality of packages may be placed in a carton which carton includes an integral moisture barrier within the above MVTR range The invention is not limited to the embodiment hereinbefore described which may be varied in both detail and process step without departing from the spirit of the invention.

What is claimed is:

1. A method of powder coating a water-soluble package comprising a composition enclosed within a water-soluble film which method comprises dusting the package with a powder thereby depositing powder on at least a portion of an exposed surface of the package.

2. A method according to claim 1 wherein said powder is sprayed to form a cloud, or distributed as a falling curtain and the water-soluble packages passed through the cloud or falling curtain.

3. A method according to claim 2 which comprises dropping said water-soluble package through said cloud of powder under gravity thereby depositing powder on at least a portion of an exposed surface of the package.

4. A method according to claim 3 wherein said cloud of powder is maintained as a fluidised bed.

5. A method according to claim 3 wherein said powder has an average particle size of between 5 and 15 microns.

6. A method according to claim 5 wherein said powder is a member selected from the group consisting of talc, starch, zinc stearate, calcium stearate and any combination thereof.

7. A method according to claim 6 wherein said powder is talc.

8. A method according to claim 6 wherein said powder is deposited in an amount of from 0.5 to 10 mg/100 $cm^2$ on the exposed surface of the package.

9. A method according to claim 3 wherein said water-soluble film comprises polyvinyl alcohol or modified polyvinyl alcohol and wherein the composition is a liquid detergent comprising between 1 and 15% water.

10. A method according to claim 9 wherein the package is formed by thermoforming envelopes or by a vertical form fill seal technique.

11. A water-soluble package according to claim 1 comprising a composition enclosed within a water-soluble film, wherein at least a portion of an exposed surface of the package is dusted with powder.

12. A package according to claim 10 wherein said composition is a liquid detergent comprising between 1 and 15% water.

13. A package according to claim 12 wherein said water-soluble film comprises polyvinyl alcohol or modified polyvinyl alcohol.

14. A package according to claim 12 wherein said powder has an average particle size of between 5 and 15 microns and is a member selected from the groups consisting of talc, starch, zinc stearate, calcium stearate and any combination thereof.

15. A package according to claim 14 wherein the powder is talc.

16. A package according to claim 14 wherein said powder is present in an amount of from 0.5 to 10 mg/100 $cm^2$ on the exposed surface of the package.

17. A package according to claim 15 wherein said powder is present in an amount of from 1.25 to 2.5 mg/100 $cm^2$.

* * * * *